US011697995B2

(12) United States Patent
Stettner et al.

(10) Patent No.: US 11,697,995 B2
(45) Date of Patent: Jul. 11, 2023

(54) AIRFOIL FOR A TURBOMACHINE

(71) Applicant: MTU Aero Engines AG, Munich (DE)

(72) Inventors: Axel Stettner, Dachau (DE); Ulf Koellmann, Munich (DE)

(73) Assignee: MTU Aero Engines AG, Munich (DE)

( * ) Notice: Subject to any disclaimer, the term of this patent is extended or adjusted under 35 U.S.C. 154(b) by 0 days.

(21) Appl. No.: 18/056,999

(22) Filed: Nov. 18, 2022

(65) Prior Publication Data

US 2023/0160309 A1 May 25, 2023

(30) Foreign Application Priority Data

Nov. 23, 2021 (DE) ..... 10 2021 130 682.5

(51) Int. Cl.
*F01D 5/20* (2006.01)

(52) U.S. Cl.
CPC ..... *F01D 5/20* (2013.01); *F05D 2240/307* (2013.01); *F05D 2260/941* (2013.01)

(58) Field of Classification Search
CPC ..... F01D 5/20; F05D 2240/307
See application file for complete search history.

(56) References Cited

U.S. PATENT DOCUMENTS 4,875,831 A 10/1989 Fetiveau
8,790,088 B2 7/2014 Dyer et al.
8,951,008 B2 * 2/2015 Cornelius ..... F01D 5/20 415/173.1
9,399,918 B2 * 7/2016 Geppert ..... F01D 5/20
10,190,418 B2 * 1/2019 Kwon ..... F01D 5/20
10,533,429 B2 * 1/2020 Bloxham ..... F01D 5/284
11,085,308 B2 * 8/2021 Bruni ..... F01D 5/20
11,274,558 B2 * 3/2022 Bruni ..... F01D 5/141
2007/0077149 A1 4/2007 Lejars et al.
2012/0269638 A1 10/2012 Dyer et al.
2014/0044553 A1 * 2/2014 Geppert ..... F04D 29/164 416/223 R
2018/0245469 A1 8/2018 Bloxham et al.
2020/0157952 A1 * 5/2020 Bruni ..... F01D 5/20
2020/0362876 A1 * 11/2020 Bruni ..... F04D 29/522
2021/0140324 A1 * 5/2021 Bruni ..... F01D 5/20

FOREIGN PATENT DOCUMENTS

EP 1624192 A1 2/2006
EP 2696031 A1 2/2014
EP 3421724 A1 1/2019
EP 3645841 A1 5/2020

* cited by examiner

*Primary Examiner* — Eldon T Brockman
(74) *Attorney, Agent, or Firm* — Hinckley, Allen & Snyder, LLP; David R. Josephs

(57) ABSTRACT

The invention relates to an airfoil as well as to a method for producing an airfoil for a turbomachine, comprising a leading edge and a trailing edge joined to each other by a suction side and a pressure side and which, in at least one region, extends in a curved manner from an airfoil root to an airfoil tip, wherein the airfoil tip has a squealer tip, which is arranged at the airfoil tip.

12 Claims, 4 Drawing Sheets

AIRFOIL FOR A TURBOMACHINE

BACKGROUND OF THE INVENTION

The invention relates to an airfoil for a turbomachine, comprising a leading edge and a trailing edge joined to each other by a suction side and a pressure side and which, in at least one region, extends in a curved manner from an airfoil root to an airfoil tip. Furthermore, the invention relates to a compressor having such an airfoil as well as to a turbomachine.

It is known that, for a reduction of different kinds of flow losses in a design of a three-dimensional airfoil, such as, for example, a blade profile, an inclination or a bending of the airfoil in the peripheral direction or a twisting of the airfoil is applicable. In addition, it is known that blade tips of airfoils in turbomachines, such as, for example, of rotating blades in aircraft engines, are regularly subjected to vibrational stresses. These vibrational stresses can cause cracks, for example, either in a tip-side armor plating and/or in the airfoil body. For the reduction of vibrational stresses in the blade tips, it is known to design blade tips in a cross-sectionally tapered manner opposite adjacent airfoil sections. Such blade tips, referred to as "squealer tips," are known in many embodiments and, for example, can be designed on the pressure side or on the suction side.

SUMMARY OF THE INVENTION

Starting from this, it is an object of the present invention to specify an improved airfoil for a turbomachine, which, in particular, exhibits an improved vibrational stress behavior. This is achieved in accordance with the invention by the teaching of the independent claims. Advantageous embodiments of the invention are the subject of the dependent claims.

Proposed for achieving the object in a first aspect of the invention is an airfoil for a turbomachine, which has a leading edge and a trailing edge that are joined to each other by a suction side and a pressure side and that, in at least one region, extends in a curved manner from an airfoil root to an airfoil tip. The airfoil tip here has a squealer tip, which is arranged along a centroid curve at the airfoil tip, with the centroid curve passing through the centroidal axes of the airfoil.

A curved region of an airfoil can have, for example, a curvature, a bending, or an inclination of a pressure side or of a wall of the pressure side or of a suction side or of a wall of the suction side in a lengthwise extent and/or in a transverse extent. Such a curvature can be based on a torsion or twist of the airfoil around one of its axes and/or, in particular, on a continuous change in cross-sectional profiles of the airfoil over its height. For example, a profile thickness of the airfoil can change while the cord lengths remain constant, cross-sectional profiles that are spaced apart from one another can be twisted, or an edge angle can exhibit a change over the airfoil height.

A squealer tip is, in particular, a cross-sectionally tapered region of the airfoil tip, which, for example, can be formed by a suction-side tapering and/or a pressure-side tapering of the airfoil tip. Such a tapering can be created, in particular, by the removal of material or by a constriction in the region of the airfoil tip, with a region of the airfoil tip that faces away from the former region remaining unchanged. The squealer tip has a height in the axial direction of the airfoil, a length that extends between the leading edge and the trailing edge of the airfoil, and a width extending between a suction-side flank and a pressure-side flank of the squealer tip. The cross section in relation to the height and the width of the squealer tip or the size(s) of the respective tapering(s) is determined from the geometry of the airfoil and the requirements placed on the airfoil, in particular in regard to the occurrence of vibrational stresses during operation. The design of a squealer tip in terms of the cross section thereof is not the focus of the present invention and, accordingly, is treated only peripherally.

In an embodiment, it is possible to provide a suction-side tapering in the airfoil in at least one region of a lengthwise extent of the squealer tip, that is, along the airfoil tip, with a pressure-side wall of the airfoil forming the pressure-side flank of the squealer tip. Moreover, in at least one other region of a lengthwise extent of the squealer tip, it is possible to provide a pressure-side tapering in the airfoil, with a suction-side wall of the airfoil forming the suction-side flank of the squealer tip. In addition, in at least one other region of a lengthwise extent of the squealer tip, it is possible to provide a tapering towards the two sides thereof, as a result of which both flanks of the squealer tip are displaced inward in relation to the airfoil walls, at least in a section that faces the front end of the squealer tip. The front end of the squealer tip thereby forms the outermost airfoil tip.

One flank or both flanks of the squealer tip can be rounded in a section that is adjacent to one of the walls of the airfoil and, in particular, the rounding can take the shape of a concave surface, as a result of which it is possible to create a mechanically stable structure of the squealer tip.

At the front end of the airfoil tip, the centroid curve extends through centroidal axes of cross-sectional surfaces of the airfoil that are perpendicular to the profile centerline. A centroidal axis is, in particular, the neutral fiber or the geometric central axis of such a cross-sectional surface. The profile centerline is the line connecting the circle center points inscribed in a profile of the airfoil tip/a profile section of the airfoil and, at each point, has the same distance to the suction side and to the pressure side. The centroid curve extends, in particular, between the leading edge and the trailing edge of the airfoil tip and can be arranged offset toward the pressure side in a region that faces the leading edge with respect to the profile centerline and/or offset toward the suction side in a region that faces the trailing edge with respect to the profile centerline.

As a result of the arrangement of the squealer tip along the centroid curve, it is possible to reduce vibrational stresses at the blade tip, as a result of which a risk of cracking in the region of the airfoil tip can be reduced and the vibrational stress behavior of the airfoil can be improved.

In an embodiment of the airfoil, the squealer tip is arranged on both sides of the centroid curve. In particular, the squealer tip is designed, in particular over the entire height thereof, in such a way that a centroidal axis of the airfoil extends within a cross section of the squealer tip at least at one position of the centroid curve. In particular, in a region in which the centroid curve is arranged in a suction-side or pressure-side edge region, it is possible to make use of an embodiment of the squealer tip in which a flank is formed by a side wall of the airfoil in order to arrange the squealer tip on both sides of the centroid curve. The squealer tip is thereby arranged at least essentially in a centered manner around neutral fibers of the airfoil, as a result of which a reduction in a vibrational stress at the airfoil tip is made possible.

In an embodiment of the airfoil, the squealer tip is arranged, in particular in at least one region of its lengthwise extent, at least essentially symmetrically around the centroid curve. In particular, in this case, the flanks of the squealer tip have a largely symmetrical shape or a symmetrical shape, in particular at least in one region of its lengthwise extent, in relation to the central plane thereof. For example, the flanks of the squealer tip can be designed to be parallel to each other over the height thereof, in particular in at least one section, or spaced equally apart in relation to a central axis of the squealer tip and/or a radius or a bevel in the transition from the airfoil cross section to the squealer-tip cross section can be essentially constant.

In an embodiment of the airfoil, the squealer tip is designed to be continuous, that is, free of discontinuities. In particular, the squealer tip is designed to be uniform or even invariant in its lengthwise extent between the leading edge and the trailing edge of the airfoil in relation to a width and/or a height. In particular, a cross-sectional width at the front end of the squealer tip can hereby be designed to be uniform or even invariant. In this way, it is possible to achieve an improved radial gap sealing in the airfoil tip region.

In a further embodiment, a height, a width, and/or, a flank geometry of the squealer tip can be designed to be changeable over the course thereof along the centroid curve in order to make possible a flexible adaptation to airfoil geometries and/or stress requirements.

In an embodiment of the airfoil, a cross section of the squealer tip is smaller than a cross section of the airfoil tip. It is hereby possible, for example, for a height of the squealer tip to be greater than the width thereof, for the width of the squealer tip to be greater than the height thereof, or for the height and the width of the squealer tip to be designed to be essentially equal. Owing to the reduction in cross section brought about by the squealer tip, it is possible to reduce vibrational stresses in the airfoil tip region, as a result of which, a higher capability of the blades to withstand loads is made possible.

The invention also relates to an airfoil arrangement for a turbomachine, which has at least one airfoil described herein. In this case, an airfoil arrangement comprises a rotor disk and a plurality of rotating airfoils arranged radially on it. In particular, the airfoils are joined here to the rotor disk in a form-fitting manner or the airfoil arrangement has a plurality of airfoils that are joined in one piece to the rotor disk in a material-bonded manner (blisk). Such a design of the airfoil arrangement makes possible a higher capability to withstand loads and can contribute to a better aerodynamic efficiency of the airfoil arrangement.

The invention further relates to a compressor for a turbomachine, which has at least one airfoil designed as described herein and/or at least one airfoil arrangement described herein. The compressor can be designed as a low-pressure compressor or as a high-pressure compressor.

The invention further relates to a turbomachine, which has at least one airfoil described herein and/or at least one airfoil arrangement described herein. In an embodiment, the airfoils of a plurality and preferably all of the compressors or turbine stages are designed in a way that is in accordance with the invention.

In a further aspect, a method for producing an airfoil for a turbomachine is proposed. In a first step a), the centroidal axes of the airfoil are determined depending on a blade geometry. In step b), a centroid curve at the airfoil tip is determined depending on the centroidal axes. In step c), an arrangement of the squealer tip is determined depending on the determined centroid curve and, in step d), the airfoil with the squealer tip is produced in accordance with the arrangement determined in step c).

On the basis of the predetermined airfoil geometry, which, in particular, has at least a curvature, a centroidal axis or the neutral fiber of a cross-sectional surface of the airfoil perpendicular to the profile centerline of the airfoil is hereby determined. On the basis of a plurality of centroidal axes that, in particular, are determined in this way, it is possible to determine a centroid curve, in particular at the front end of the airfoil tip.

On the basis of the determined centroid curve, it is possible to determine a course of the squealer tip at the airfoil tip, and, in particular, by applying further design criteria, for example, to determine the height thereof, the width thereof, and a flanks geometry of the squealer tip. In particular, it is possible to determine specifications relating to a placement and design of taperings or material removals, in particular along the centroid curve or offset from the centroid curve.

During production of the airfoil, material can be removed from the blade tip depending on the established arrangement and/or the geometry in order to provide the squealer tip.

A use of an airfoil described herein in an airfoil arrangement and/or in a compressor and/or in a turbomachine is also a subject of the present disclosure. In addition to the proposed use of the airfoil in a compressor of a turbomachine, the proposed design of the squealer tip is applicable to all airfoils in a turbomachine that are subject to vibrational stresses, in particular to turbine airfoils and also to cantilevered stators of a turbomachine.

In general, the disclosure of the airfoil described herein, of the air foil arrangement, of the compressor, and of the turbomachine also applies to a corresponding method for designing or for producing an airfoil and vice versa. The features and advantages of the various aspects and exemplary embodiments described above and below can be combined, unless explicitly stated otherwise.

BRIEF DESCRIPTION OF THE DRAWINGS FIGURES

Further features, advantages, and possible applications of the invention ensue from the following description in connection with the figures. Herein:

Figure 3A:
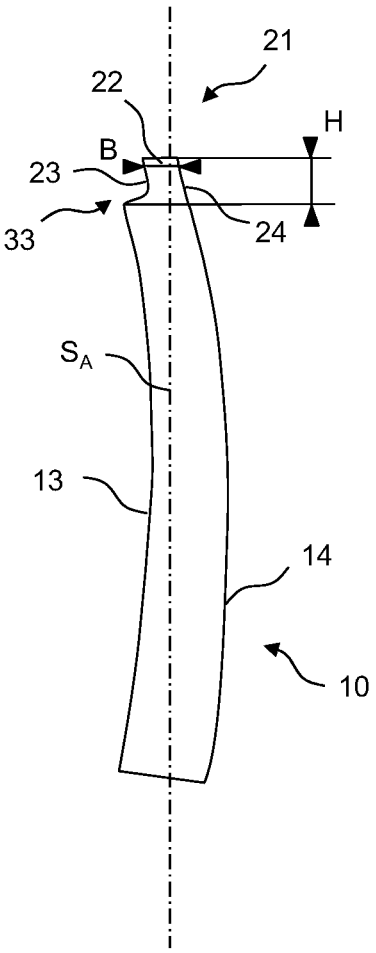
Figure 3B:
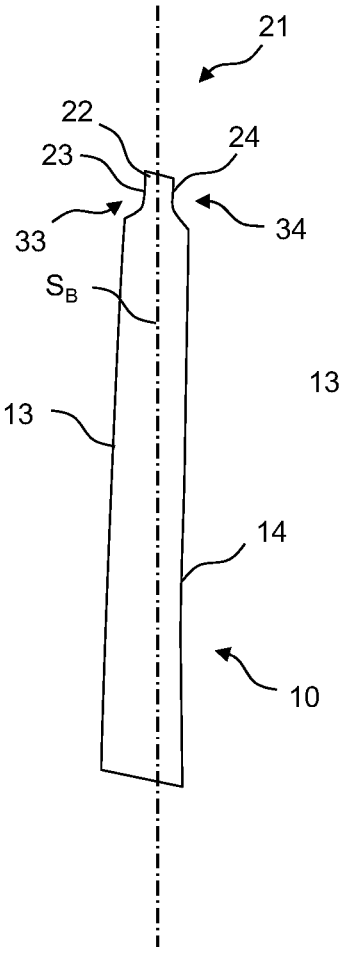
Figure 3C:
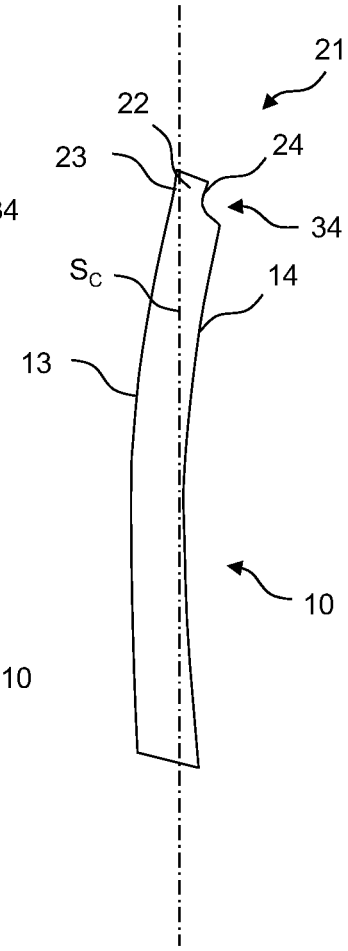
Figure 4:
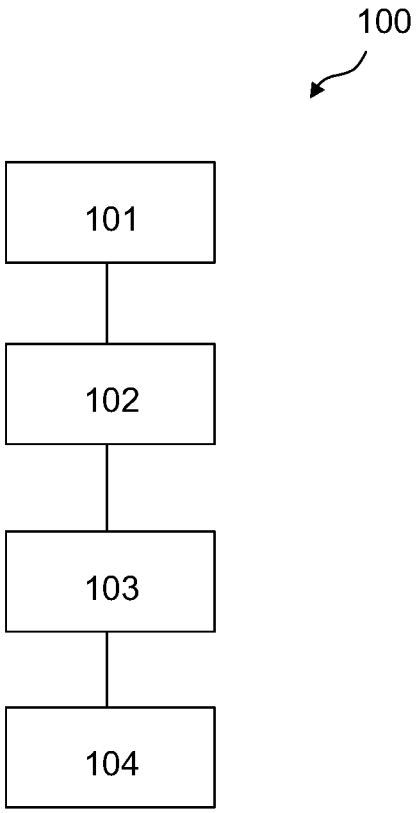

FIGS. 3*a* to 3*c* show schematic illustrations of three airfoil cross sections of an exemplary airfoil according to the invention; and FIG. 4 shows a schematic diagram of a flow chart of an exemplary method for the production of an airfoil for a turbomachine.

DESCRIPTION OF THE INVENTION

Figure 1:
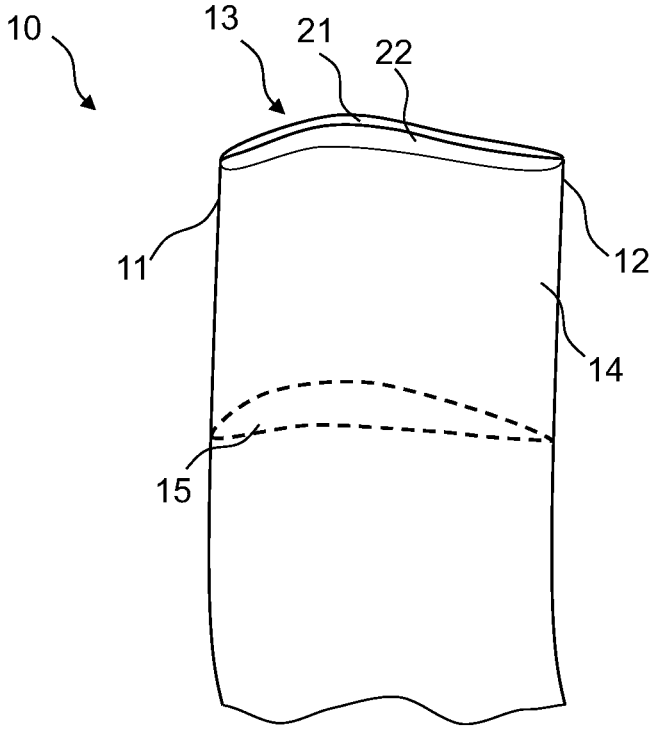
FIG. 1 shows a schematic illustration of an exemplary airfoil according to the invention for a turbomachine.

FIG. 1 shows an exemplary embodiment of an airfoil 10 for a turbomachine in a schematic illustration. The airfoil has a leading edge 11 and a trailing edge 12, which are joined to each other by a suction side 13 and a pressure side 14. The airfoil 10 hereby extends, in at least one region, in a curved manner from an airfoil root, which is not illustrated, to an airfoil tip 21. Such a curvature is indicated schematically by a change in the geometric profile 15.

Figure 2:
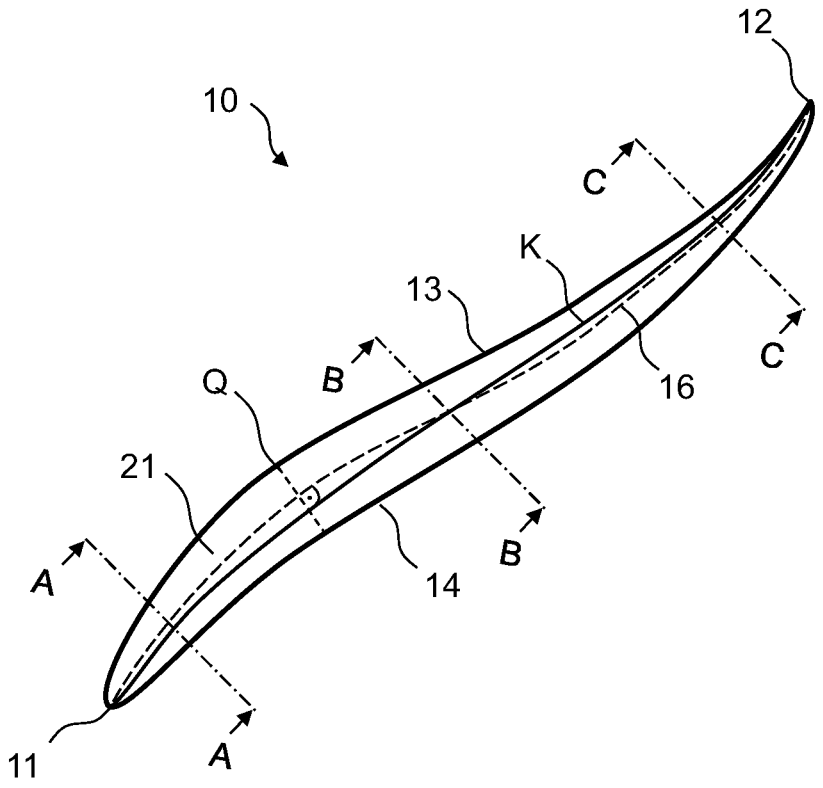
FIG. 2 shows a schematic illustration of a profile of an exemplary airfoil according to the invention for a turbomachine.

The airfoil tip 21 has an essentially continuously designed squealer tip 22, which is arranged along a centroid curve at the airfoil tip 21, with the centroid curve extending through the centroidal axes of the airfoil 10 (see FIG. 2). The squealer tip 22 hereby has a cross section, which, in particular, is orthogonal to the profile centerline, and which is smaller than such a cross section of the airfoil tip 21.

FIG. 2 shows a schematic illustration of the airfoil tip 21 of the airfoil 10 from FIG. 1. The airfoil 10 extends between an inflow-side leading edge 11 and a trailing edge 12. The airfoil 10 has a suction side 13 and an opposite-lying pressure side 14.

At each point, a profile centerline 16 has the same distance with respect to the suction side 13 and the pressure side 14 of the profile of the airfoil 10. A centroid curve K of the airfoil 10 extends at the airfoil tip 21 through centroidal axes of cross-sectional surfaces Q of the airfoil 10 that are perpendicular to the profile centerline 16.

FIGS. 3*a* to 3*c* each show a schematic illustration of three airfoil cross sections of the exemplary curved airfoil 10 from FIG. 2. At its airfoil tip 21, the airfoil 10 has the squealer tip 22 with a suction-side flank 23 and a pressure-side flank 24.

FIG. 3*a* shows a schematic illustration of the exemplary section A-A from FIG. 2 at a first centroidal axis $S_A$ in a first region of the airfoil 10. It can be seen in FIG. 3*a* that the squealer tip 22 has a height H starting from, in particular, an unchanged airfoil cross section and extending to the front end of the squealer tip 22. Furthermore, the squealer tip 22 has a width B, which is delimited by the suction-side flank 23 and the pressure-side flank 24 and is arranged, in particular, in an end region of the squealer tip 22, in which the suction-side flank 23 and the pressure-side flank 24 are designed to be at least essentially parallel to each other.

The squealer tip 22 is arranged on both sides of the centroidal axis $S_A$ or of the centroid curve K, with a suction-side tapering 33 being arranged at the airfoil tip 21 of the airfoil 10 in order to form the suction-side flank 23 of the squealer tip 22. The pressure-side wall 14 of the airfoil 10 forms the pressure-side flank 24 of the squealer tip 22. The squealer tip can be designed in such a way, in particular, in a region facing the leading edge 11 and/or in a region spaced apart from an inflection point of the centroid curve K.

FIG. 3*b* shows a schematic illustration of the exemplary section B-B from FIG. 2 at a second centroidal axis $S_B$ in a second region of the airfoil 10. The squealer tip 22 is hereby arranged essentially symmetrically around the second centroidal axis $S_B$ or around the centroid curve K. The airfoil tip 21 has a tapering 33, 34 on both the suction side and the pressure side, as a result of which the flanks 23, 24 of the squealer tip 22 are arranged displaced inward in relation to an airfoil cross section.

FIG. 3*c* shows, a schematic illustration of the exemplary section C-C from FIG. 2 at a third centroidal axis Sc in a third region of the airfoil 10. The squealer tip 22 is still arranged on both sides of the centroidal axis Sc or of the centroid curve K, with a pressure-side tapering 34 being arranged at the airfoil tip 21 of the airfoil 10 in order to form the pressure-side flank 24 of the squealer tip 22. The suction-side wall 13 of the airfoil 10 forms the suction-side flank 23 of the squealer tip 22. The squealer tip 22 can be designed in this way, in particular, in a region facing the trailing edge 12 and/or in a region spaced apart from an inflection point of the centroid curve K.

FIG. 4 shows a schematic illustration of a flow chart of an exemplary method 100 for designing or producing an airfoil 10 for a turbomachine.

In a first step 101, centroidal axes S of the airfoil 10 are determined starting from a blade geometry. In a step 102, depending on the centroidal axes S, a centroid curve K is determined at the airfoil tip 21. In a further step 103, an arrangement of a squealer tip 22 is determined depending on the determined centroid curve K, and, in a step 104, the airfoil 10 with a squealer tip 22 is produced in accordance with the arrangement determined in step 103.

What is claimed is:

1. An airfoil for a turbomachine, comprising:

a leading edge and a trailing edge joined to each other by a suction side and a pressure side and which, in a least one region, extends in a curved manner from an airfoil root to an airfoil tip, wherein the airfoil tip has a squealer tip, which is arranged along a centroid curve at the airfoil tip, wherein the centroid curve passes through the centroidal axes of the airfoil.

2. The airfoil according to claim 1, wherein the squealer tip is arranged on both sides of the centroid curve.

3. The airfoil according to claim 1, wherein the squealer tip is arranged at least substantially symmetrically around the centroid curve.

4. The airfoil according to claim 1, wherein the squealer tip is configured and arranged to be continuous.

5. The airfoil according to claim 1, wherein a cross section of the squealer tip is smaller than a cross section of the airfoil tip.

6. An airfoil arrangement for a turbomachine, wherein the airfoil arrangement includes at least one airfoil according to claim 1.

7. A compressor for a turbomachine, wherein the compressor includes at least one airfoil arrangement according to claim 6.

8. A turbomachine, comprising at least one airfoil arrangement according to claim 6.

9. A compressor for a turbomachine, wherein the compressor includes at least one airfoil according to claim 1.

10. A turbomachine, comprising a compressor according to claim 9.

11. A turbomachine, comprising at least one airfoil according to claim 1.

12. A method for producing an airfoil for a turbomachine, comprising the following steps:

a) determination of the centroidal axes of the airfoil depending on a blade geometry;

b) determination of a centroid curve at an airfoil tip depending on the centroidal axes;

c) determination of an arrangement of a squealer tip depending on the determined centroid curve; and d) production of the airfoil with a squealer tip in accordance with the arrangement determined in the step c).

* * * * *